US006821050B1

(12) United States Patent
Maldonado

(10) Patent No.: US 6,821,050 B1
(45) Date of Patent: Nov. 23, 2004

(54) ANTITHEFT DEVICE

(76) Inventor: Fausto Maldonado, 615 SW. 87th Ave., Miami, FL (US) 33144

( * ) Notice: Subject to any disclaimer, the term of this patent is extended or adjusted under 35 U.S.C. 154(b) by 0 days.

(21) Appl. No.: 10/638,708

(22) Filed: Aug. 11, 2003

(51) Int. Cl.[7] ..... E01F 13/04
(52) U.S. Cl. ..... 404/6; 49/49
(58) Field of Search ..... 404/6, 9, 10, 11; 256/1, 13.1; 49/49, 131

(56) References Cited

U.S. PATENT DOCUMENTS

| | | | | |
|---|---|---|---|---|
| 4,003,161 A | | 1/1977 | Collins | |
| 4,576,508 A | | 3/1986 | Dickinson | |
| 4,577,991 A | * | 3/1986 | Rolow | 404/6 |
| 4,858,328 A | | 8/1989 | Heinen | |
| 4,919,563 A | | 4/1990 | Stice | |
| 5,365,694 A | * | 11/1994 | Macaluso | 49/49 |
| 5,476,338 A | | 12/1995 | Alberts | |
| 5,848,328 A | * | 12/1998 | Ueda et al. | 399/107 |
| 5,975,592 A | | 11/1999 | Lin | |
| 5,975,792 A | | 11/1999 | Goeken et al. | |
| 6,099,200 A | | 8/2000 | Pepe et al. | |

* cited by examiner

*Primary Examiner*—Thomas B. Will
*Assistant Examiner*—Alexandra Pechhold
(74) *Attorney, Agent, or Firm*—Ruben Alcoba, Esq.; Laurence Edson, Esq.

(57) ABSTRACT

A telescoping security device comprises of a housing having a top and a bottom portion, wherein the housing is installed below ground, a first tube, having a first and second end, wherein an outer section of the first end of the first tube is mounted on the bottom portion of the housing, and wherein the first tube has an inner stopping means positioned near the first end of the first tube, and wherein the first tube is installed below ground, a second tube, having a first and a second end, placed within the first tube, wherein the second tube has an outer resting means at a position near the second end of the second tube, for resting on the stopping means of the first tube, and a stabilizing means for stabilizing the second tube within the first tube attached to the first tube within its first end. Ideally the device's second tube would have a handle attached within the first end of the second tube.

8 Claims, 6 Drawing Sheets

ANTITHEFT DEVICE

BACKGROUND

Figure 1:
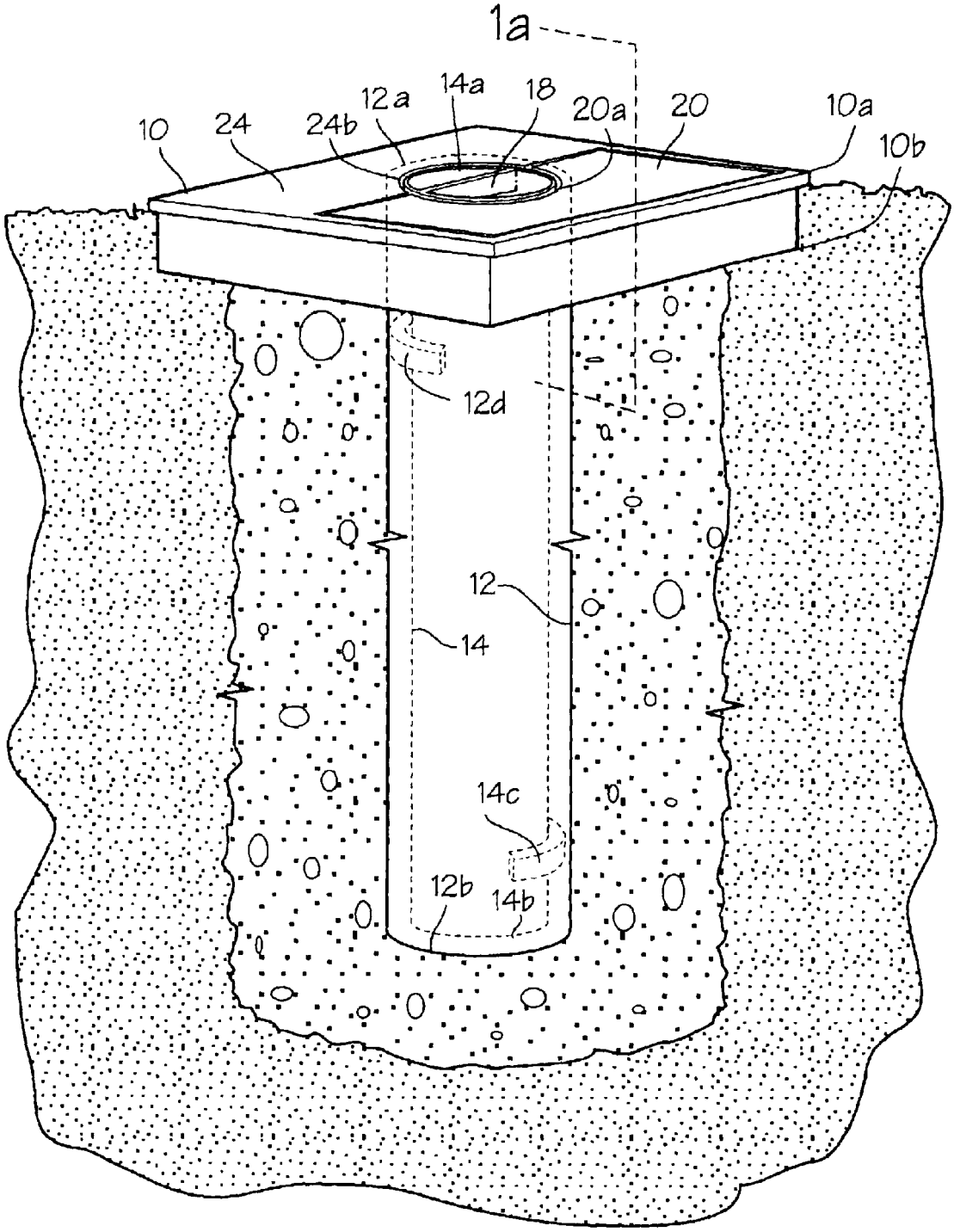
Figure 1A:
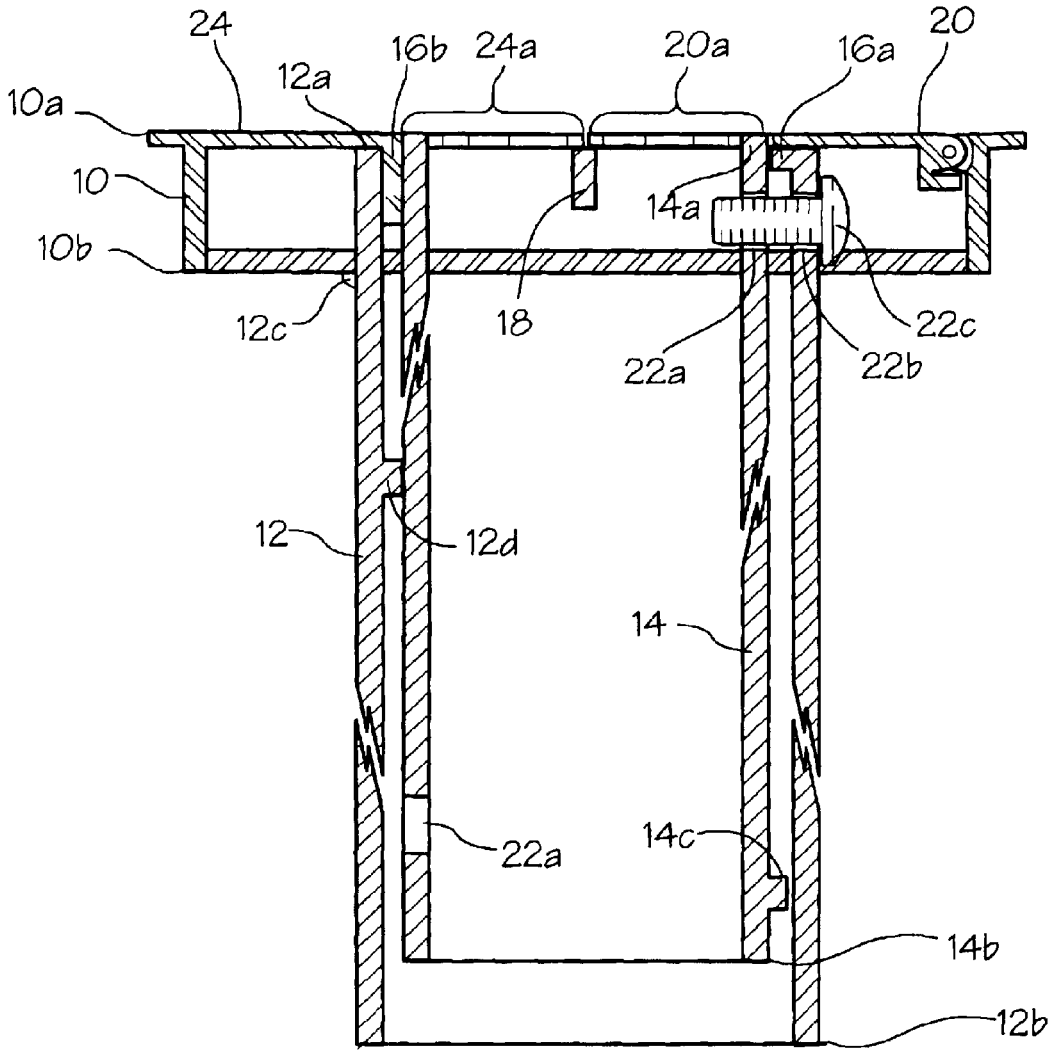
Figure 1B:
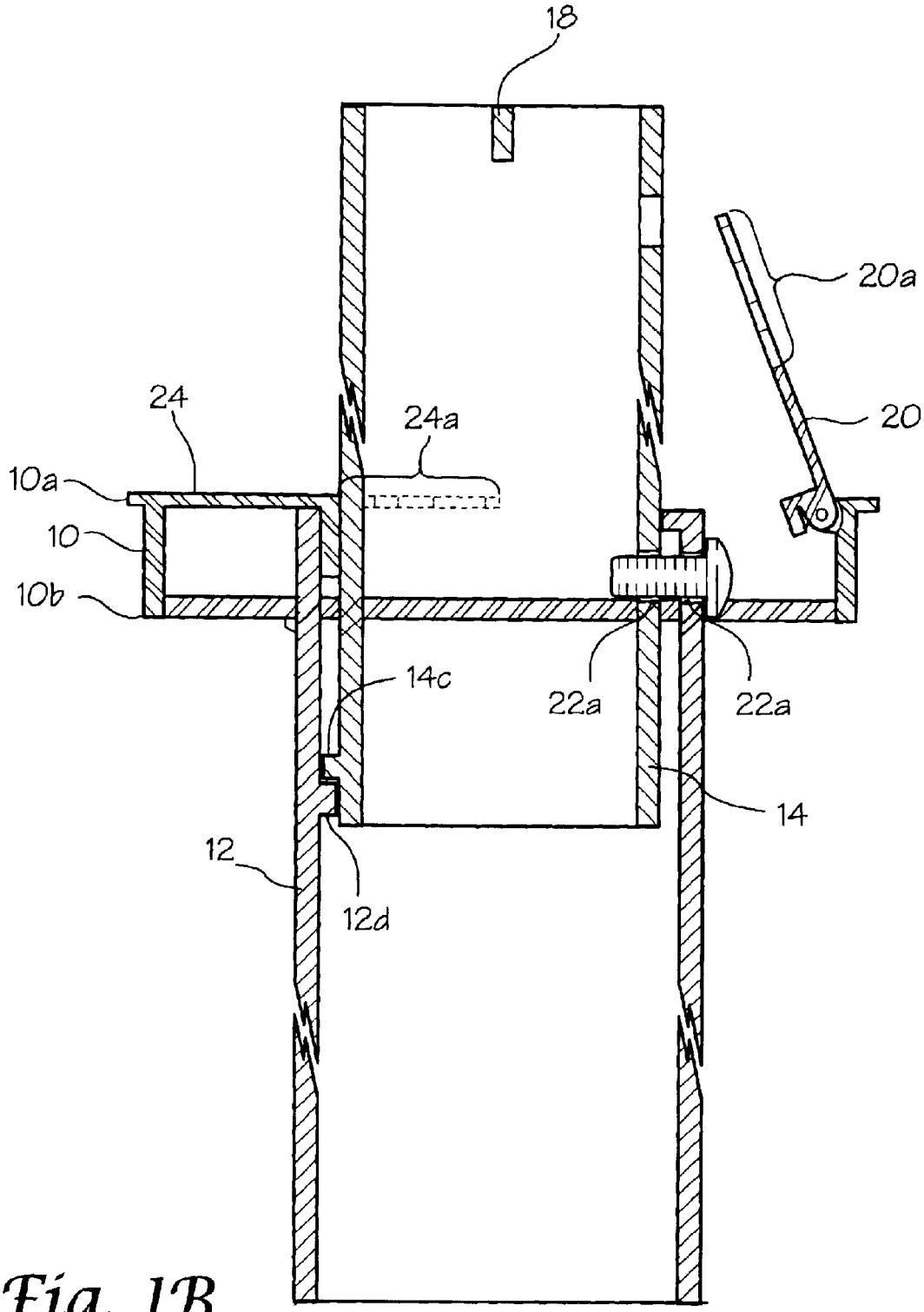

There is a need for a security device that will prevent the theft of automobiles from their secured parking spaces. It has been documented that automobiles are more likely to be stolen from ones home or place of business than from a shopping center or public place. Recognizing this problem, attempts have been made to solve the problem using devices that will lock the vehicle in place or block the vehicle in place. We will concentrate on devices that block the vehicle in place.

The most common devices attempting to solve this problem are constructed to be telescoping devices that extend and retract from a foundation casing after parking a vehicle in place. These devices are made of materials that are capable of resisting the impact of an automobile trying to leave a parking space. The devices are usually made of steel or other materials of substantial weight that make it difficult to extend the telescoping element of the devices without the need of mechanical, electrical, hydraulic, or gas means. The need to use these means makes these devices expensive to produce and thereby un-accessible to the general public.

When researching the prior art, U.S. Pat. No. 5,975,792 discussed many of the prior Patents that tried to address the need of this invention. The 5,975,792 Patent stated that the problems prior to its issuance where as follows: 1. U.S. Pat. No. 4,858,328 had some of its elements above ground, this allowed third parties to tamper with the device and had the secondary disadvantage of causing tire damage to vehicles being protected, 2. U.S. Pat. Nos. 4,919,563 and 5,476,338 use worm gear/screw lift mechanisms that are dependant on energy sources that cause environmental concerns, and both Patents use a relatively large amount of parts for their operation, 3. U.S. Pat. No. 4,003,161 uses a lever to lock the extending member in place, the use of this lever cause this invention to have moving parts that may be damaged with time, and 4. U.S. Pat. No. 4,576,508 describes a device that uses a hydraulic lift mechanism that is activated by an electrical means for its operation, Patent No. 5,975,792 states that using two power sources degrades the reliability of the device.

U.S. Pat. No. 5,975,792 shows a device that uses a gas spring member to lift the telescoping part of the device and has an excessive amount of parts that can be damaged during the use of the device.

U.S. Pat. No. 6,099,200 shows a reinforced steel device that is extended using a multi gas spring mechanism. This device is not cost effective to most users.

An object of the present invention is to provide the general public with a device that will secure their vehicles in their parking spaces once secured.

Another object of this invention is to provide a device that is easily installed and operated.

A further object of this invention is to provide the public with a cost effective security device.

Yet a further object of this invention is to provide a reliable security device that will not break down when used.

Still a further object of the present invention is to provide a device that can have at least one anti-tampering means when the device is made operational.

Lastly, a further object of the invention is to provide a device that is not dependent on chemical or electrical means to be operated.

SUMMARY

The present invention is directed to a telescoping security device that satisfies the need of having a cost effective automobile antitheft device that requires little maintenance. The telescoping security device comprises of a housing having a top and a bottom portion, wherein the housing is installed below ground, a first tube, having a first and second end, wherein an outer section of the first end of the first tube is mounted on the bottom portion of the housing, and wherein said first tube has an inner stopping means positioned near the first end of the first tube, and wherein the first tube is installed below ground, a second tube, having a first and a second end, placed within said first tube, wherein said second tube has an outer resting means at a position near the second end of the second tube, for resting on the stopping means of the first tube, and a stabilizing means for stabilizing the second tube within the fist tube attached to the first tube within its first end. Ideally the device's second tube would have a handle attached within the first end of the second tube.

The device would be used by lifting the second tube from within the first until the second tube's resting means is positioned above the first tube's stopping means and then rotating the second tube in either direction so that the resting means is placed on the stopping means of the second tube. The stabilizing means of the device serves to stabilize the second tube within the first tube and to prevent the second tube from being withdrawn from the first tube once the device is embedded on any surface. This preventive aspect of the stabilizing means also prevents third parties from tampering with the inner workings of the device.

The device can further comprise of a locking means for securing the second tube within the first tube in either an extended or a retracted position. The locking means requires two holes on the second tube, one of the holes at a position that allows a lock to be placed within second tube at the extended position and the other hole at a position that allows the second tube to rest in the retracted position. The locking means would further require the first tube to have a hole at a position that allows the second tube to rest in either the extended or the retracted position. Lastly, the locking means requires a lock that can be inserted into the holes of the first and second tubes when lined up in either position.

The locking means is a cost effective anti-tampering device that relies on no moving parts besides the lock itself.

This invention is simplistic and cost effective in its nature, because the inventor's main goal is to allow the common man to have an effective auto theft device at his home or workplace. Today, most people do not have the luxury of having full coverage insurance on their automobile nor do they have the money for paying for some of the more complicated ways of securing their automobiles.

DRAWINGS

Figure 2:
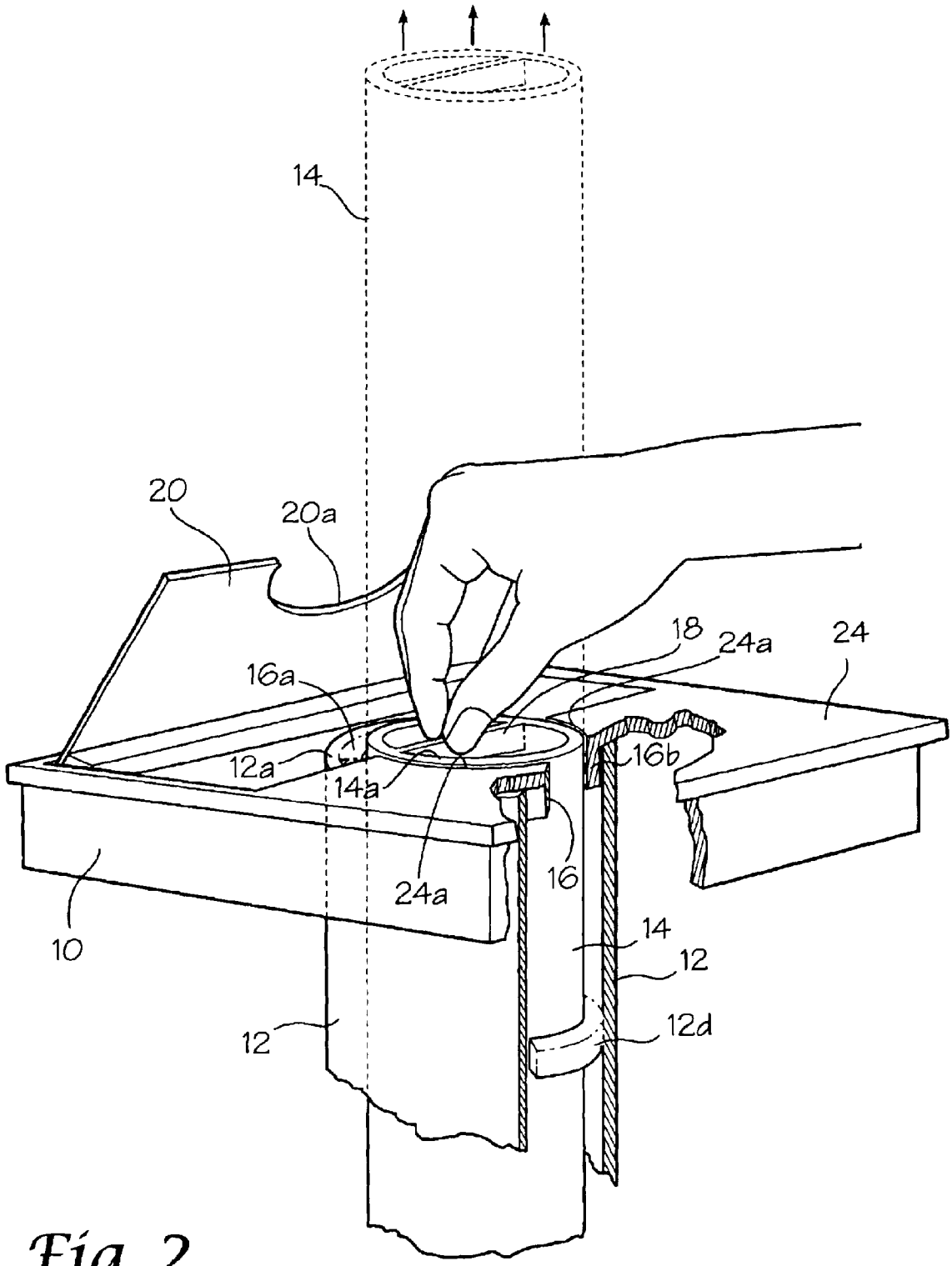
Figure 3A:
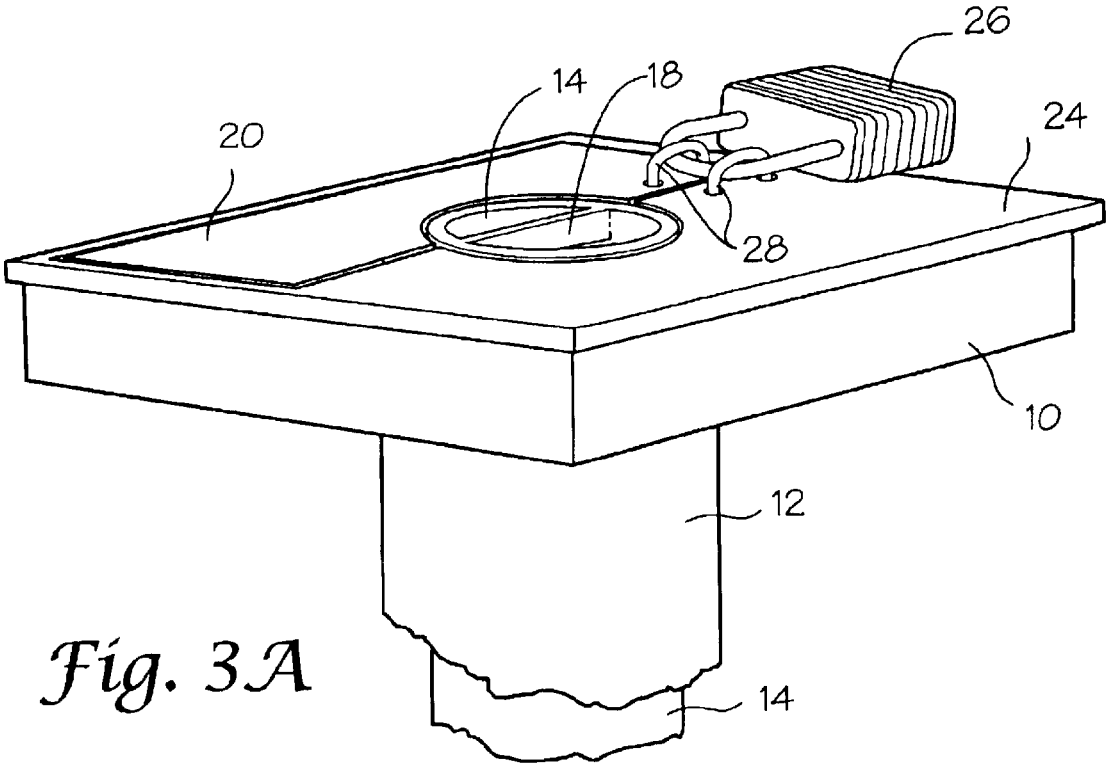
Figure 3B:
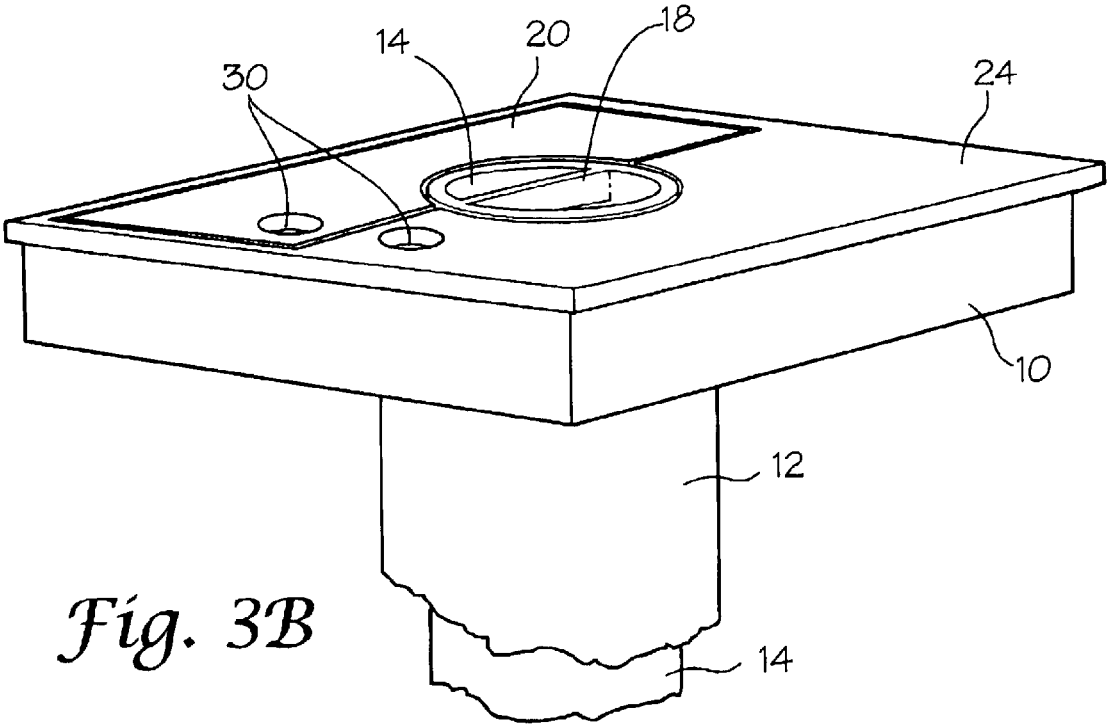
Figure 4:
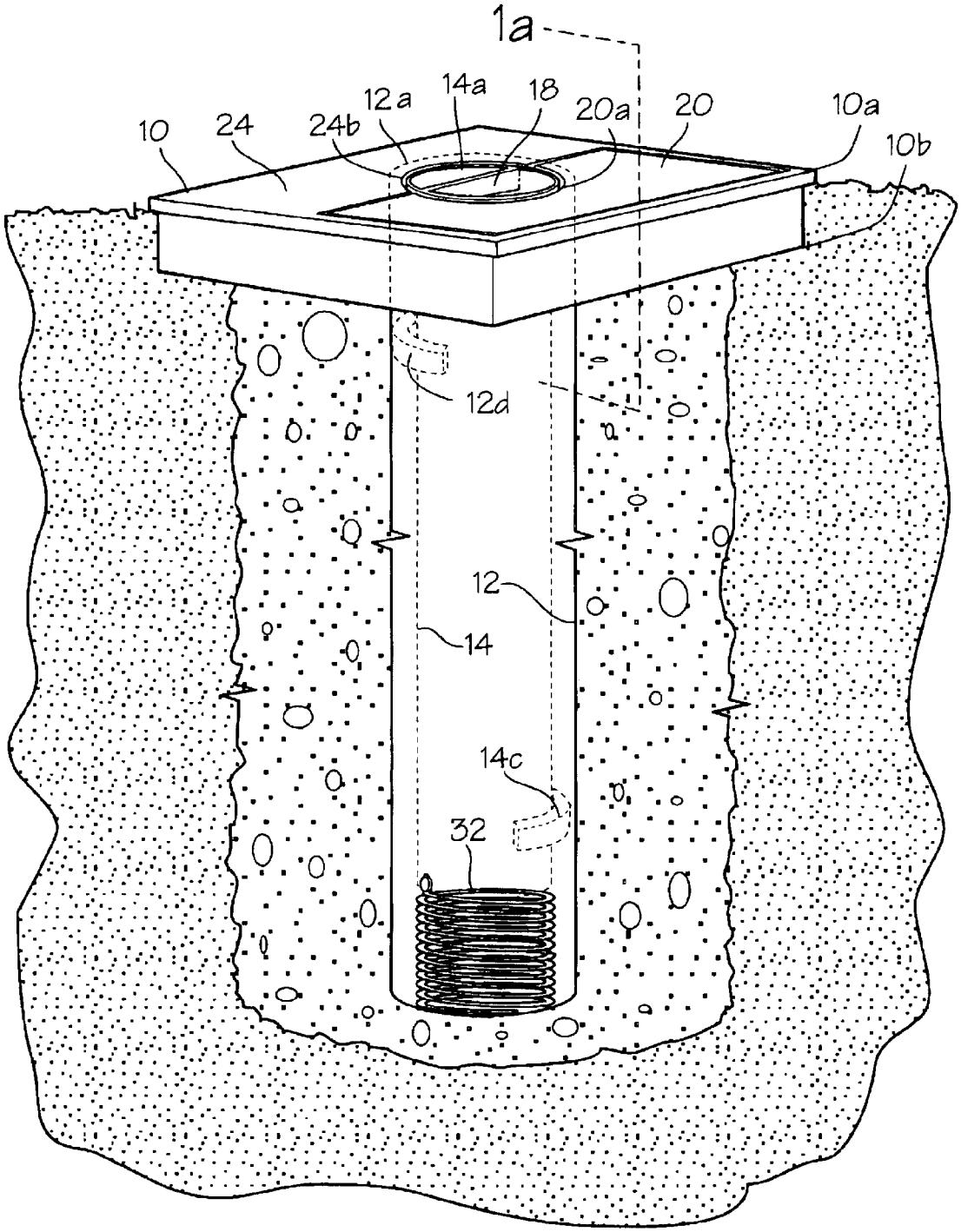

These and other features, aspects, and advantages of the present invention will become better understood with regard to the following description, appended claims, and accompanying drawings where:

FIG. 1 shows a perspective view of a telescoping security device;

FIGS. 1 *a–b* show cross sectional views of the telescoping security device illustrating the extended and retracted position;

FIG. 2 shows a perspective of the security device, highlighting the semicircular sheet and cover that covers the device;

FIGS. 3*a–b* show perspective views of other versions of this invention illustrating a cover in the closed position, showing different versions of the second locking means; and FIG. 4 shows a perspective view of another version of the current invention, this embodiment adds a spring element.

DESCRIPTION

As shown in FIG. 1 a telescoping security device comprises a housing 10 having a top 10*a* and a bottom portion 10*b*, wherein the housing is installed below ground, a first tube 12, having a first 12*a* and second 12*b* end, wherein an outer section 12*c* of the first tube's first end is mounted to the bottom portion of the housing 10*b*, and wherein said first tube 12 has an inner stopping means 12*d* positioned near the first end of the first tube 12*a*, and wherein the first tube 12 is installed below ground, a second tube 14, having a first 14*a* and a second end 14*b*, placed within said first tube 12, wherein said second tube 14 has an outer resting means 14*c* at a position near the second end of the second tube 14, for resting on the stopping means of the first tube 12*d*, and a stabilizing means 16 for stabilizing the second tube 14 within the first tube 12 attached to the first tube 12 within its first end 12*a*. The second tube 14 can further comprise a handle 18 attached within the first end of the second tube 14*a*. The housing 10 can further comprise of a cover 20 attached to the top portion of the housing 10*a*. FIG. 1 also shows a locking means 22, the locking means is broken into three components. The first component of the locking means 22 is set of first holes 22*a* defined within the body of the second tube 14. The second component of the locking means 22 is a second hole 22*b* defined within the body of the first end of the first tube 12*a*. The third component of the locking means 22 is a lock 22*c* that is placed within the holes of the first 12 and second 14 tubes once they are lined up in either the extended or retracted position.

The housing 10 of this invention, ideally is square shaped and has a depth of 4 inches, the width and the length of the square should be sufficient to allow for a cover 20 to be placed on the housing 10 so that when the second tube 14 is extended position, the cover 20 can surround the body of the second tube 14 and rest on top portion of the housing 10*a*. In a preferred embodiment of the invention, as shown in FIG. 2 a portion of the top portion of the housing 10*a* would be permanently covered by a sheet of material 24 that indents in a semicircular manner 24*a* on the side of the sheet not attached the top portions of the housing 10 so that the second tube 14 can be extended upward without hindrance from the sheet, and the cover 20 attached to the other side of the housing 20. The side of the cover 20*a* that is opposite the side of the cover 20 that is attached to the housing 10 might also be indented in a semicircular manner so that when the second tube is extended upward, the cover 20 can be placed to rest flush with the top portion of the housing 10*a*. The advantage to this design is that it prevents third parties from tripping over the cover 20. As shown in FIGS. 3*a–b*, another advantage to this design is that it allows for a second lock 26 to be placed between the sheet 24 covering the housing 10 and the cover 20, when the cover 20 is made to rest flush with the top of the housing 10*a*. The second lock 26 can be placed on either latches 28 that protrude outward from the sheet 24 and the cover 20 or can be placed in holes 30 defined within the body of the sheet 24 and the cover 10. Ideally, the cover 10 and the sheet of material 24 would be made of steel or any other materials suited for the purpose of security. The housing 10 can be made of steel or any other material suited for the purpose of security.

The first tube 12 is made of steel that has a thickness of at least one quarter of an inch thick or any other material with the same quality of strength, the height of the first tube is at least thirty-six inches. The inner stopping means 12*d* of the first tube 12 is situated at least eight inches from the top of the first tube's first end 12*a*, the inner stopping means is a semicircular ledge extending inward from the first tube 12 and running along less than half of the circumference of the first tube 12. The first tube 12 further defines a hole 22*b* located above the inner stopping means 12*d*.

The second tube 14 is made of steel that has a thickness of at least one quarter of an inch thick or any other material with the same quality of strength, the height of the second tube is at least thirty-six inches. The outer resting means 14*c* of the second tube 14 is situated at least eight inches from the bottom of the second tube's second end 14*b*, the outer resting means is a semicircular ledge extending outward from the second tube 14 and running along less than half of the circumference of the second tube 14. The second tube 14 further defines two holes 22*a*, one hole 22*a* is located below the outer resting means 14*c* and the second hole 22*a* is located near the first end of the second tube 14*a*, the second hole 22*a* would be positioned at a distance that would allow the second hole 22*a* to be flush with the hole of the first tube 22*b* when the second tube 14 is in the retracted position.

No matter what the measurements of the first 12 and second 14 tubes are in this invention, it is essential that the first tube's 12 length is sufficient to allow the second tube 14 to be placed within first tube 12 and the second tube's 14 length is sufficient to prevent a vehicle from passing through and over the second tube's 14*a* first end, when the second tube's resting means 14*c* is placed on the first tube's stopping means 12*d*.

The stabilizing means 16 can be of any material that can be attached to the inner walls and along the circumference of the first tube's first end 12*a*, the stabilizing means 16 would be flush with the mouth of the first tube's end 12*a* and run a small distance toward the first tube's second end 12*b*. The stabilizing means 16 can be attached to the first tube 12 by welding or any other attachment means know in the art.

Another embodiment of the invention comprises of having a spring 32 resting on the bed of where the first tube is embedded and attaching to the second tube's second end 14*b*, as seen in FIG. 4. The spring is of a resistance that would facilitate the lifting of the second tube 14 to the extended position while not making it too difficult to retract the tube.

This invention would be installed by first boring/drilling a hole in the location that the antitheft device is desired, then placing the second tube 14 on the bed that has been drilled, next placing the connected housing 10, first tube 12, and stabilizing means 16 elements over the second tube 14, and lastly filling the hole with cement or other similar material so that the security device is permanently laid in place. When using the embodiment with the spring 32, the first step would be to first place the spring 32 on the bed, then to place the second tube 14 on the spring 32, and then the above procedure would follow.

After installing the invention, the invention would be used by first parking a vehicle between a structure and the device, then extending the security device upward, then rotating the second tube 14 in either direction so that the resting means of the second tube 14*c* is placed on the stopping means of the first tube 12*d*, and lastly locking the device in place.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships with those illustrated in the drawings and described in the specifications are intended to be encompassed by the present invention.

Therefore, the forgoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A telescoping security device comprised of:

a housing having a top and a bottom portion, wherein the housing is installed below ground;

a first tube, having a first and second end, wherein the first outer end of the first tube is mounted on the bottom portion of the housing, and wherein said first tube has an inner stopping means positioned near the first end of the first tube, wherein the first tube's inner stopping means is a semicircular ledge extending inward from the first tube and running along less than half of the circumference of the first tube, thereby leaving at least half the circumference of the first tube unobstructed and wherein the first tube is installed below ground;

a second tube, having a first and a second end, placed within said first tube, wherein said second tube has an outer resting means at a position near the second end of the second tube, for resting on the stopping means of the first tube, wherein the a second tube's outer resting means is a semicircular ledge extending outward from the second tube and running along less than half of the circumference of the second tube, thereby leaving at least half the circumference second tube unobstructed; and a stabilizing means for stabilizing the second tube within the first tube attached to the first tube within its first end.

2. The device of claim 1, further comprising a locking means for locking the second tube within said first tube at a predetermined position.

3. The device of claim 2, wherein the second tube further comprises of a handle attached within the first end of the second tube.

4. The device of claim 3, wherein the housing further comprises a cover attached to the top portion of the housing.

5. The device of claim 4, wherein the first tube's length is sufficient to allow the second tube to be placed within the first tube and the second tube's length is sufficient to prevent a vehicle from passing through and over the second tube's first end, when the second tube's resting means is placed on the first tube's stopping means.

6. The device of claim 5, further comprising a spring having a first and a second end, wherein the first end of the spring is attached to the second end of the second tube and the second end of the spring is attached to the ground surrounding the second end of the first tube.

7. The device of claim 4, wherein the cover surrounds the second tube when it is rested on the first tube so that the cover is flush with the top of the housing, and wherein the cover has a second locking means for securing the cover in place.

8. A method of use, using the device of claim 3, comprising the steps of:

parking a vehicle between a structure and the device;

lifting the second tube of the device until the resting means of the device is above the stopping means of the device;

turning the second tube in either direction until the resting means of the second tube is placed on top of the stopping means of the first tube; and locking the first and second tubes in place with a locking means.

* * * * *